US006212844B1

(12) United States Patent
Lange

(10) Patent No.: US 6,212,844 B1
(45) Date of Patent: Apr. 10, 2001

(54) ARCHITECTURAL BEARING WALL CONSTRUCTION INCORPORATING COURSES OF FIBERBOARD PLANKS OR THE LIKE

(76) Inventor: Bernard Lange, 3 Tuft Rd., Lexington, MA (US) 02421

( * ) Notice: Subject to any disclaimer, the term of this patent is extended or adjusted under 35 U.S.C. 154(b) by 0 days.

(21) Appl. No.: 09/351,430

(22) Filed: Jul. 12, 1999

(51) Int. Cl.[7] ..... E04B 1/02

(52) U.S. Cl. ..... 52/563; 52/605; 52/606; 52/586.1; 52/233; 52/105

(58) Field of Search ..... 52/604, 605, 606, 52/586.1, 563, 564, 565, 233, 105

(56) References Cited

U.S. PATENT DOCUMENTS 1,319,113 * 10/1919 Reagan ..... 52/105 X
2,687,033 * 8/1954 Snyder ..... 52/233
3,343,328 * 9/1967 Rolle ..... 52/605
4,866,905 * 9/1989 Bihy et al. ..... 52/105 X
4,905,409 * 3/1990 Cole ..... 52/233 X
4,927,696 * 5/1990 Berg ..... 52/105 X
5,666,778 * 9/1997 Grattan et al. ..... 52/605 X
5,688,079 * 11/1997 Bolduc et al. ..... 52/604 X
6,000,186 * 12/1999 Fielding et al. ..... 52/604 X
6,012,255 * 1/2000 Smid et al. ..... 52/105

* cited by examiner

*Primary Examiner*—Beth A. Stephan
*Assistant Examiner*—Brian E. Glessner
(74) *Attorney, Agent, or Firm*—Morse, Altman & Martin

(57) ABSTRACT

The construction of bearing walls is facilitated by use of superposed courses of planks that are characterized by a novel combination of composition, geometry and arrangement. These planks are composed of a homogenized dispersion of fiber and binder. This material has been found to have a suitably high compression coefficient, to be chemically inert as a practical matter from the standpoint of resistance to atmospheric conditions, and to be inexpensively produced, for example, from used newsprint and the like. The planks generally have identical dimensions, thereby enabling standardized production and ease of assembly. The planks generally are substantially greater in width than in thickness. Pairs of the planks are provided at matched end locations with aligned notches for the reception of inserts that establish spacing and weather-tight joints. The planks are nailed or otherwise interlocked in staggered courses, by which the integrity of the construction is securely maintained. Preferably, the planks have vertical cutouts, which reduce weight and which, when aligned, establish channels for the insertion of reinforcing ties and/or utility conduits.

9 Claims, 3 Drawing Sheets

ARCHITECTURAL BEARING WALL CONSTRUCTION INCORPORATING COURSES OF FIBERBOARD PLANKS OR THE LIKE

BACKGROUND OF THE INVENTION

1. Field of the Invention

The present invention relates to architectural constructions and, more particularly, to bearing wall constructions for small buildings.

2. The Prior Art

A myriad of wall constructions have been proposed for small, as well as large, architectures. Such constructions have involved various materials ranging from concrete to wood to fiberboard in various units ranging from blocks to beams to sheets. There is a need for an improved small architectural construction that facilitates the use, by amateurs as well as professionals, of standardized materials that are handy to use and that produce predictable results.

SUMMARY OF THE INVENTION

This invention is a complete insulating wall bearing system made of a multiplicity of elongated flat planks laid flat side down end to end and course upon course in a fashion unique to the building trades. This invention concerns the construction of walls between a top plate and a sill at the base of a wall. The system makes use of a dense rigid insulating material for a load bearing wall. The system makes use of an insert placed in a non-structural, non-connecting expansion or shrinkage joint. The system makes use of fasteners, such as long nails or screws, which secure courses in a vertical fashion and also prevent horizontal shear. The vertical stability of the constructed wall is determined by the width at the base of the wall. This stability is increased by an imposed load at the top. Additional vertical structural members are not required. Abutting planks in a horizontal course are not structurally engaged. Rather, they are secured to continuous courses of planks below and above a joint.

Thus, the primary object of the present invention is to facilitate the construction of bearing walls by use of superposed courses of planks that are characterized by a novel combination of composition, geometry and arrangement. These planks preferably are composed of a homogenized dispersion of fiber and binder, preferably, cellulosic fiber and organic binder. This material has been found to have a suitably high compression coefficient, to be chemically inert as a practical matter from the standpoint of resistance to atmospheric conditions, and to be inexpensively produced, for example, from recycled newsprint or the like. It is to be understood, however, that these planks, in alternative embodiments of the present invention, may be composed of lumber, plywood, particle board and the like. The planks generally have dimensions which enable standardized production and ease of assembly. The planks generally are substantially greater in width than in thickness. As a result, their effective moment of compression has a maximal vertical vector and a minimal horizontal vector, by which buckling is inherently precluded. The contiguous ends of abutting planks are spaced from each other by about $1/8^{th}$ inch. Pairs of the planks are provided at matched end locations with aligned notches for the reception of inserts that establish weather-tight joints. The purpose of these inserts is to establish weather-tight joints and to allow movement during wall construction. The planks are nailed or otherwise interlocked in staggered joints, by which the integrity of the construction is securely maintained. Preferably, the planks have vertical cutouts, which reduce weight and which, when aligned, establish channels for the insertion of utility conduits.

Other objects of the invention will in part be obvious and will in part appear hereinafter.

BRIEF DESCRIPTION OF THE DRAWINGS

For a fuller understanding of the nature and objects of the present invention, reference is made to the following description, which is to be taken in connection with the accompanying drawings, wherein.

DETAILED DESCRIPTION OF THE PREFERRED EMBODIMENT

Figure 1:
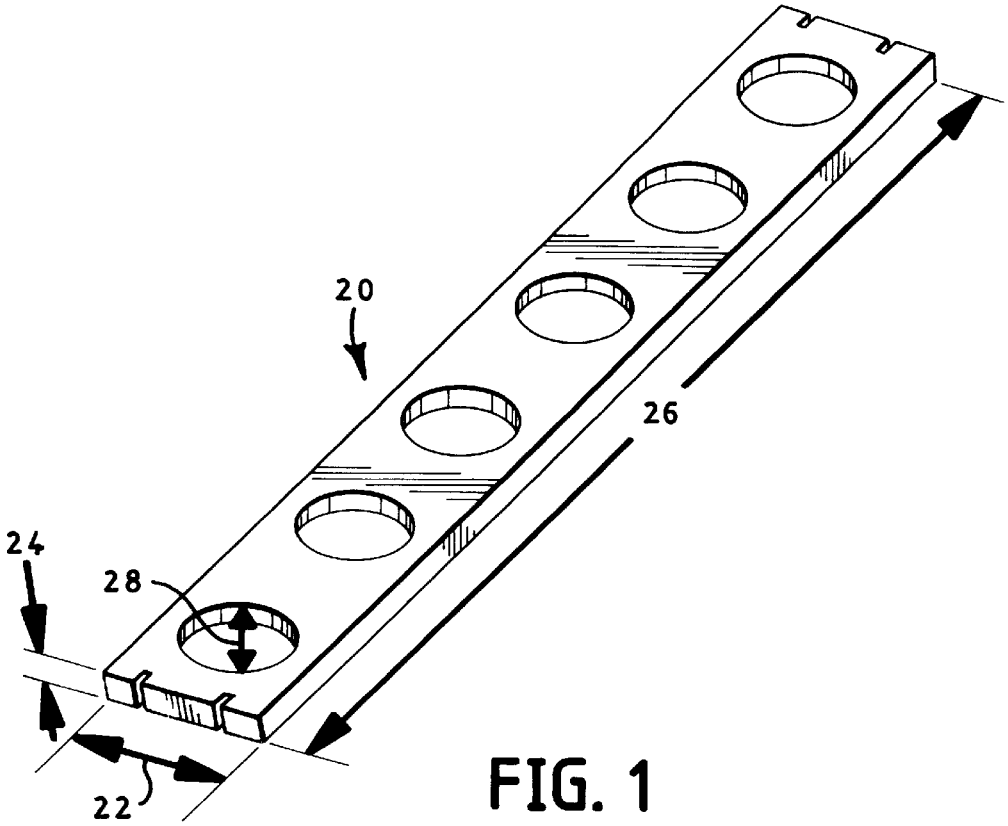
FIG. 1 is a perspective view of one embodiment of a plank for use in accordance with the present invention.
Figure 2:
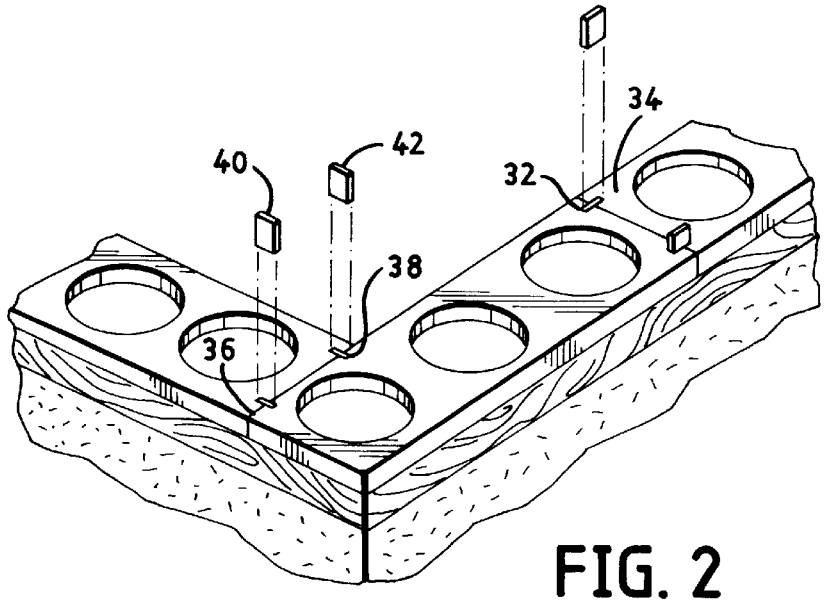
FIG. 2 shows a broken-away corner section of a single course of planks of an architectural construction embodying the present invention.

A plank for use in accordance with the present invention is shown at 20 in FIG. 1. Preferably, this plank is composed of a homogenized and compacted dispersion of a cellulosic fiber and an organic binder of the type sold under the trade designation HOMASOTE by Homasote Corporation. This material has been found to have a suitably high compression coefficient, to be chemically inert as a practical matter from the standpoint of resistance to atmospheric conditions, and to be produced, for example, from recycled newsprint and the like. This plank is thermally insulating, sound absorbing and capable of accepting a normal distributed load. As indicated above, the plank may be composed alternatively of lumber, plywood, particle board, or the like.

A typical bearing wall construction embodying the present invention has courses of planks 20. As shown in FIG. 1, the primary configuration of these planks critically ranges in dimensions from 8 to 16 inches wide as shown at 22, from ¾ inch to 3 inches thick as shown at 24, and from 5 to 20 feet long as shown at 26. Typically, these primary configurations are cut from original lengths that have the aforementioned dimensions of width and thickness, but that range initially from 5 to 20 feet long.

The planks generally have- dimensions that enable standardized production and ease of assembly. It is to be noted that these planks generally are substantially greater in width than in thickness. As a result, stacked courses of these planks are characterized by an effective moment of compression that has a maximal vertical vector and a minimal horizontal vector, by which buckling of the stack is inherently precluded.

As shown, plank 20 has equidistant circular cutouts 28, which range from 4 to 12 inches in diameter. In alternative embodiments, these cutouts are of shapes other than circular. The cutouts are not structural and are intended primarily to minimize weight and to provide workmen at the job site with handgrips for picking up and positioning planks in the wall under construction.

Figure 5:
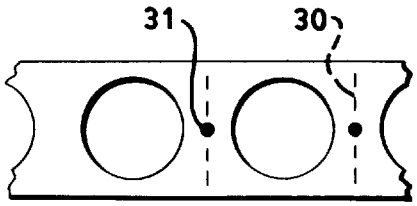
FIG. 5 shows a broken-away plan view of another embodiment of a plank for use in accordance with the present invention.

In a preferred embodiment of the present invention, as shown in FIG. 5, the cutouts are separated by equidistant graphical indicia 30, e.g. lines, that contribute to ease of cutting to size and assembling at the job site. Preferably, pairs of adjacent lines on a plank are spaced apart at a distance that is equal to the width of the plank so as to allow for overlap at corners and to enable the use of cut-off pieces that, in practice, may be used at other parts of the construction to minimize or eliminate waste. Preferably, at the center of each of lines 30, are factory drilled holes 31 that are about $1/8^{th}$ inch in diameter and that serve as markers for 1 inch holes that are to be drilled for the reception of tie rods if required by laws.

In a typical bearing wall construction embodying the present invention, pairs of the planks are provided at matched end locations 32 and 34 with pairs of aligned and equidistantly spaced notches 36 and 38 for the reception of pairs of inserts 40 and 42. Each pair of equidistant notches is located either at a transverse extremity or at a longitudinal extremity of a plank. In other words, each pair of notches is located transversely at matched corner positions at the end of a plank, or longitudinally at matched side positions adjacent to the end of a plank.

Figure 3:
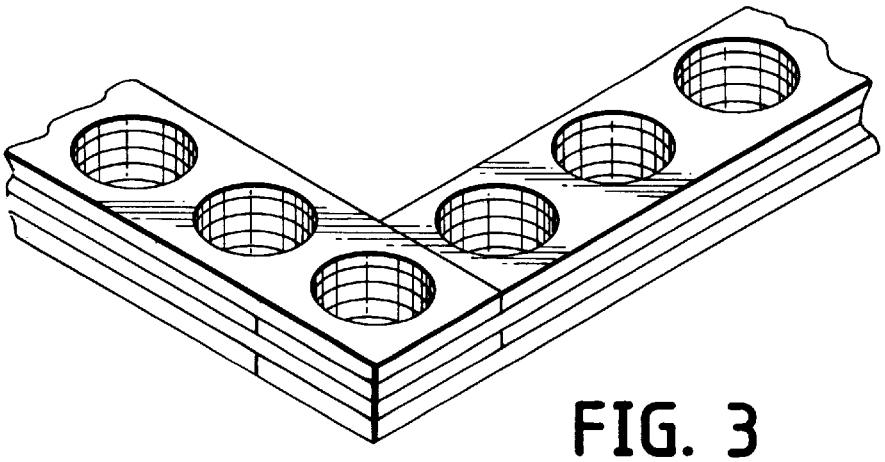
FIG. 3 shows a broken-away corner section of several courses of planks of an architectural construction embodying the present invention.
Figure 4:
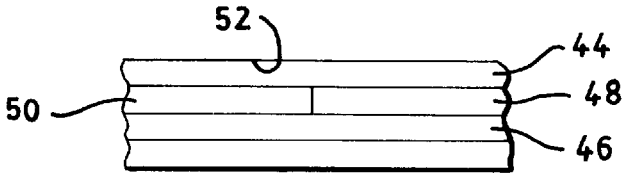
FIG. 4 shows a side view of the construction of FIG. 3.

A corner consisting of cross-lapped planks is shown in FIG. 3. As shown in FIG. 4, continuous plank sections 44 and 46 are located below and above abutting plank sections 48 and 50. There is no structural engagement or tie between abutting planks in the same course. The purpose of the inserts is to establish weather-tight joints and to properly space the matched end locations from each other to compensate for any slight movement or shrinkage that may occur. Preferably, the inserts are composed of metal or plastic and are press-fitted snugly into their respective notches.

As shown, an assemblage of the planks are joined by nails, screws or other fasteners 52. The planks so interlocked are arranged in staggered courses, by which the integrity of the construction is securely maintained. Preferably, a majority of nails or screws penetrate at least three of the courses of planks. The fasteners provide two functions: (1) they secure planks together in a vertical and horizontal fashion; and (2) they prevent horizontal shear and eliminate the type of racking that can occur in frame constructions using studs and columns. The arrangement is structural and insulating.

In one embodiment, the surfaces of the bearing walls of the present invention are adapted to be finished with stucco, paint, plaster or other treatment. In areas where hurricanes and tornadoes may occur, there is a danger that flying objects may impact and pierce the constructed wall. Here, the cutout holes may be filled with sand at the top before the top plate is installed. The sand will resist and disperse the impact load of the flying objects.

Operation

Figure 6:
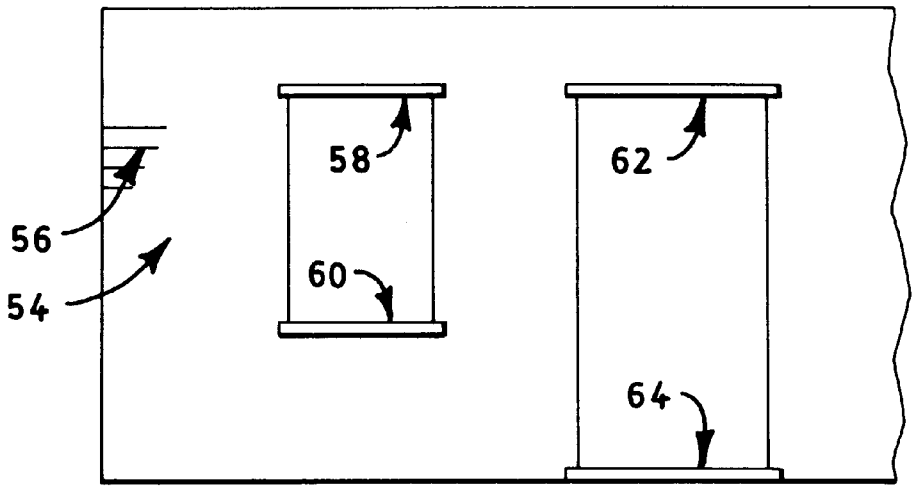
FIG. 6 illustrates a side view of a wall pursuant to the present invention with a door and window.
Figure 7:
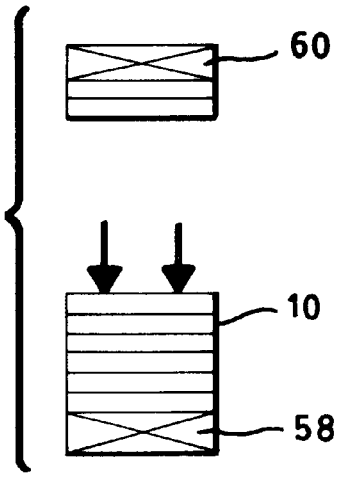
FIG. 7 illustrates a physical principle of the present invention.
Figure 8:
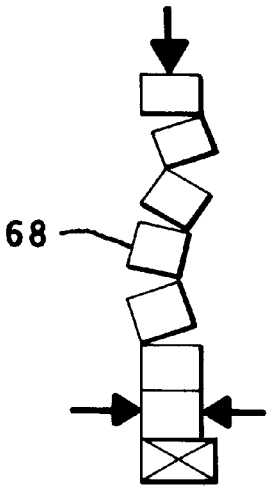
FIG. 8 illustrates a physical principle of the prior art.
Figure 9:
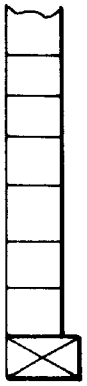
FIG. 9 illustrates another physical principal of the prior art.

As shown in FIG. 6, a structural wall 54 of the present invention is composed of a multiplicity of planar courses 56 of superposed elongated flat planks laid flat side down. Optional solid planks 58, 60, 62 and 64 are provided for sills and for concealing lintels. Generally, the vertical cutouts are sufficiently large to reduce weight and, when aligned, establish channels for utility conduits. Some building codes require that tie rods be installed between the foundation or sill at the base and the top plate. Holes drilled in the field, about one inch in diameter, allow insertion of such tie rods. These holes are easily located at pre-drilled pilot holes 31. FIGS. 7, 8 and 9 illustrate the basic operation of the present invention. As shown in FIG. 7, a stack of planks 10 will not tend to buckle. Distributed loads 66 from joists, rafters and trusses provide additional stability. As shown in FIG. 8, a stack of planks or other structural unit 68, having a width of 6 inches or less, is much more likely to buckle than a stack of planks embodying the present invention. This is so even if, as shown in FIG. 9, the prior art stack is transversely supported. Furthermore, planks composed of the preferred cellulosic fiber and organic binder will not tend to crumble, as will concrete or masonry. Thus, a wall constructed pursuant to the present invention is adapted for use in geographical regions having earthquakes, tornadoes and hurricanes.

What is claimed is:

1. In an architectural construction, a bearing wall comprising:

(a) a plurality of superposed courses of planks having planar faces, sides and ends;

(b) said planks generally having identical dimensions of width and thickness;

(c) each dimension in width being substantially greater than each dimension in thickness;

(d) pairs of said planks being provided at pairs of matched end locations with pairs of aligned notches;

(e) pairs of inserts in said pairs of aligned notches;

(f) said planks being composed of a compacted fiber and binder composition, said fiber being organic; and (g) fasteners joining said planks, said fasteners penetrating contiguous courses of said planks.

2. The architectural construction of claim 1, wherein said planks have spaced and aligned cutouts.

3. The architectural construction of claim 2, wherein each plank is provided with graphical indicia between said cutouts, each adjacent pair of said graphical indicia being spaced from each other by a distance equal to said uniform width of said planks.

4. The architectural construction of claim 3, wherein said planks are characterized by a width ranging from 8 to 16 inches.

5. The architectural construction of claim 4, wherein said planks are characterized by a thickness ranging from ¾ inch to 3 inches.

6. The architectural construction of claim 5, wherein said planks are characterized by a length ranging from 5 to 20 feet.

7. The architectural construction of claim 6, wherein said planks are characterized by cutouts having a maximum dimension ranging from 4 to 12 inches.

8. In an architectural construction, a bearing wall comprising:

(a) a plurality of superposed courses of planks having planar faces;

(b) said planks generally having certain identical dimensions;

(c) each dimension in width being substantially greater than each dimension in thickness;

(d) pairs of said planks being provided at pairs of matched end locations with pairs of aligned notches;

(e) pairs of inserts in said pairs of aligned notches;

(f) said planks being composed of a compacted cellulosic fiber and organic binder composition;

(g) said planks being provided with equidistantly spaced circular cutouts;

(h) said planks being characterized by a width ranging from 8 to 16 inches;

(i) said planks being characterized by a thickness ranging from ¾ inch to 3 inches;

(j) said planks being characterized by a length ranging from 5 to 20 feet;

(k) said planks being characterized by circular cutouts having a diameter ranging from 4 to 12 inches;

(l) fasteners joining said planks, said fasteners penetrating contiguous courses of said planks;

(m) each plank having graphical indicia between said cutouts, the graphical indicia of each pair of graphical indicia being spaced from each other by a distance equal to said uniform width of said planks.

9. An architectural construction comprising:

(a) bearing walls and corners thereof substantially formed from stacked courses of planks having planar faces, sides and ends;

(b) each plank being composed of a homogenized and compacted dispersion of a cellulosic fiber and an organic binder, said fiber being derived from a member of the class consisting of recycled newsprint, lumber, plywood, and particle board;

(c) said dispersion having a high compression coefficient, being chemically inert from the standpoint of resistance to atmospheric conditions, and being thermally insulating, sound absorbing and capable of accepting a normal distributed load;

(d) said plank having a primary configuration ranging in dimensions from 8 to 16 inches wide,from ¾ inch to 3 inches thick, and from 5 to 20 feet long;

(e) said primary configurations being cut from original lengths that possess said primary configuration, whereby said plank generally has dimensions that enable standardized production and ease of assembly;

(f) said plank being generally substantially greater in width than in thickness, whereby said stacked courses of said planks are characterized by an effective moment of compression that has a maximal vertical vector and a minimal horizontal vector, by which buckling of said stack is inherently precluded;

(g) said plank having equidistant circular cutouts that range from 4 to 12 inches in diameter;

(h) said cutouts being adapted to minimize weight and to provide handgrips for picking up and positioning said planks;

(i) said cutouts being separated by equidistant graphical indicia for easing of cutting to size and assembling;

(j) pairs of adjacent lines on said plank being spaced apart at a distance that is equal to the width of the plank so as to allow for overlap at corners;

(k) said plank having smaller holes at the centers of each of said lines that serve as markers for larger holes that are to be drilled for the reception of tie rods if required by law;

(l) pairs of said planks being provided at matched end locations with pairs of aligned and equidistantly spaced notches for the reception of pairs of inserts;

(m) each said pair of notches being located either at a transverse extremity or at a longitudinal extremity of said plank. (n) said inserts being adapted to establish weather-tight joints and to properly space said matched end locations from each other to compensate for any slight movement or shrinkage that may occur;

(o) said inserts being composed of a member of the class consisting of metal and plastic, and being press-fitted snugly into their respective notches;

(p) fasteners penetrating and joining at least three of the courses of said planks;

(q) said fasteners securing said planks together vertically and horizontally, and to limit horizontal shear;

(r) said walls and corners presenting substantially flat faces that are adapted to be coated with paint or stucco.

* * * * *